US005377462A

United States Patent [19]

Beals et al.

[11] Patent Number: 5,377,462

[45] Date of Patent: Jan. 3, 1995

[54] DOOR FRAME ASSEMBLY JIG

[76] Inventors: Michael Beals, P.O. Box 161, Tomahawk, Wis. 54487; Brian Marine, 52556 Robin Rd., Marshfield, Wis. 54449

[21] Appl. No.: 95,787

[22] Filed: Jul. 22, 1993

[51] Int. Cl.[6] ..... E04F 21/00

[52] U.S. Cl. ..... 52/127.2; 269/904

[58] Field of Search ..... 52/127.2, 204.1, 745.15, 52/745.16, 204.56, 712, 713; 269/904, 905; 248/354.3, 354.4; 33/194

[56] References Cited

U.S. PATENT DOCUMENTS

| | | | |
|---|---|---|---|
| 773,176 | 10/1904 | Washington | 33/194 |
| 1,595,164 | 8/1926 | Mundy et al. | 33/194 |
| 2,403,369 | 7/1946 | Huber | 52/712 |
| 2,914,812 | 12/1959 | Christian et al. | 52/127.2 |
| 2,914,813 | 12/1959 | Christian et al. | 52/127.2 |
| 2,914,814 | 12/1959 | Christian et al. | 29/127.2 |
| 3,027,686 | 4/1962 | Oates | 52/127.2 |
| 3,168,305 | 2/1965 | Lee | 269/904 |
| 3,199,206 | 8/1965 | Snapp | 269/905 |
| 4,048,771 | 9/1977 | Thistlethwaite | 52/127.2 |
| 5,025,607 | 6/1991 | Green et al. | 52/749 |
| 5,240,032 | 8/1993 | Mizioch | 248/354.4 |

FOREIGN PATENT DOCUMENTS

| | | | |
|---|---|---|---|
| 816455 | 10/1951 | Germany | 52/127.2 |
| 1684311 | 10/1969 | Germany | 52/657 |
| 653885 | 5/1951 | United Kingdom | 269/904 |

*Primary Examiner*—James L. Ridgill, Jr.
*Attorney, Agent, or Firm*—Quarles & Brady

[57] ABSTRACT

An assembly jig for bracing a metal door frame includes a pair of squaring braces that fit into diagonally opposite corners of metal door frame that square the door frame and a door-spreading brace that interacts with the squaring braces at a single point which properly spaces the side jambs of the door frame. The squared door frame may be plumbed with a pair of plumbing braces which attach to the floor by means of an anchor plate.

5 Claims, 2 Drawing Sheets

DOOR FRAME ASSEMBLY JIG

FIELD OF THE INVENTION

The present invention relates to the field of construction aids, and in particular to an apparatus for simplifying the installation of metal door frames.

BACKGROUND OF THE INVENTION

When constructing masonry or concrete block walls having door frames, it is difficult to keep the door frame squared and in plumb while erecting the adjacent wall. Metal door frames, in particular, are subject to significant misalignment as a result of their flexibility. While it is relatively simple to shim an improperly hung wooden door frame, metal door frames are not so easily adjusted. Often, reconstruction of the surrounding masonry is required to properly reinstall a misaligned metal door frame.

To minimize the misalignment of metal door frames, numerous horizontal and vertical door frame supports have been patented. Some devices are used to ensure that the side jambs remain properly separated and perpendicular to the floor. Some devices provide a rigid adjustable frame, sized to fit within the door frame. Still other devices provide positioning braces for the door frame corners with floor-anchored plumbing braces. A few known devices provide an adjustable frame, side jamb spacer, and anchored plumbing braces.

Although existing devices do aid in the installation of metal door frames, what is lacking is an apparatus that, without complexity, stabilizes the width and right-angularity of a metal door frame by overlapping the stabilizing braces at a single point, thereby ensuring the uniformity of the door frame construction.

SUMMARY OF THE INVENTION

The present invention is summarized in that a pair of diagonal squaring braces overlap at their midpoints with a horizontal door-spreading brace to force a metal door frame into proper configuration. Attaching a pair of floor-mounted plumbing braces to the door-spreading brace permits the squared door frame to be further fixed vertically perpendicular to the floor and in a plumb position.

It is an object of the present invention to provide an apparatus that reduces the time and labor required to square and plumb a metal door frame.

It is another object of the present invention to provide an apparatus that ensures that a metal door frame built into a masonry or concrete block wall is coplanar with the wall.

It is another object of the present invention to provide an apparatus that is economical to produce, easy to transport, and easy to assemble, yet which provides sufficient support to a door frame to ensure that it is installed accurately.

It is yet another object of the present invention to provide a door frame assembly apparatus that adjusts to fit door frames having a variety of heights, widths and jamb sizes.

It is still another object of the present invention to provide an apparatus that remains in a rigid and fixed position throughout construction of adjacent walls.

Other objects, features, and advantages of the present invention will become apparent from the following specification when taken in conjunction with the accompanying drawings.

BRIEF DESCRIPTION OF THE DRAWINGS

The present invention will be described in more detail with reference to the following drawings.

DETAILED DESCRIPTION OF THE INVENTION

The present invention rigidly fixes the plane of a metal door frame principally using only three overlapping braces. With the addition of two plumbing braces, and an anchoring plate, the rigid door frame is plumbed to vertical as well.

Figure 1:
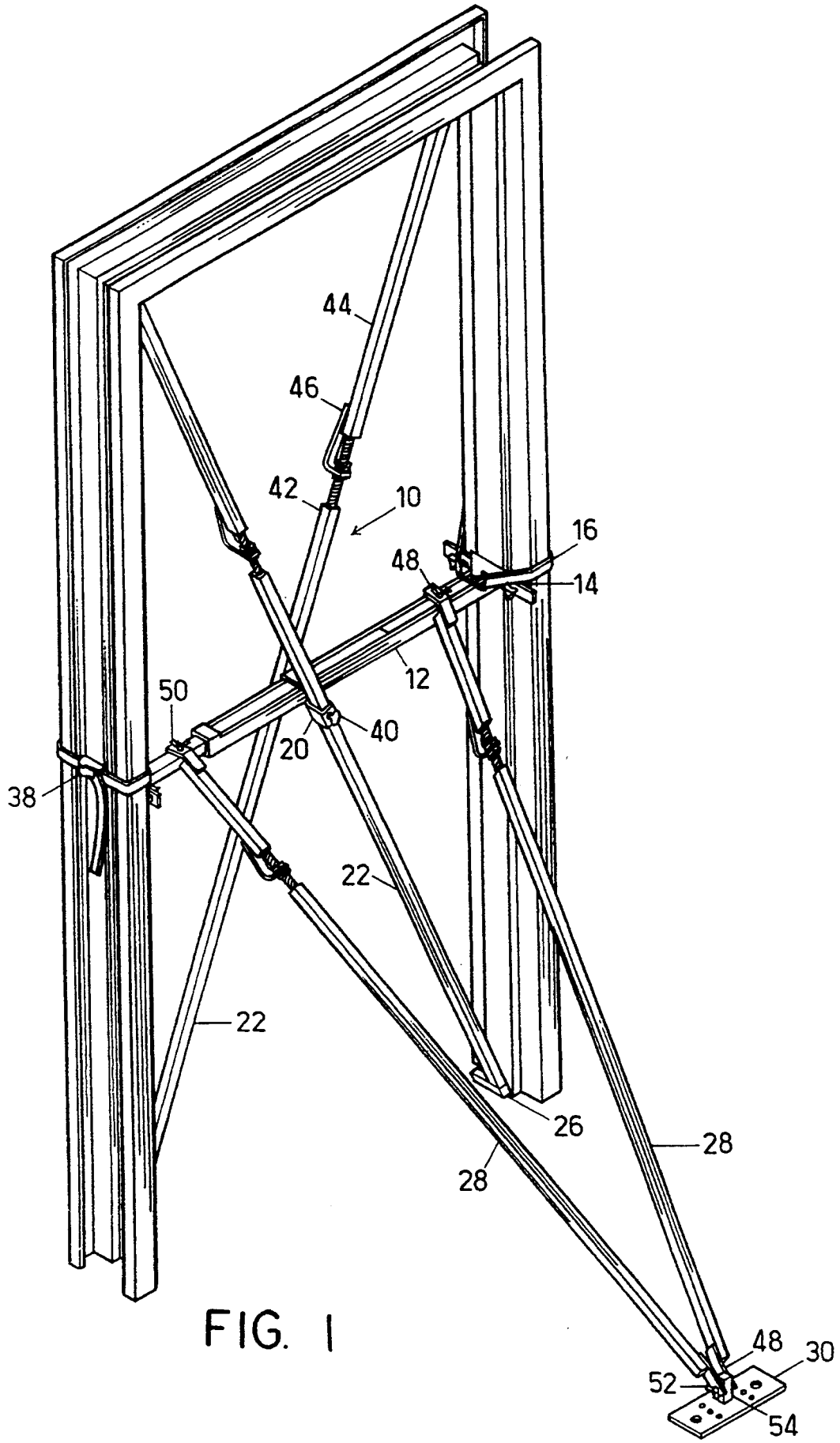
FIG. 1 shows an embodiment of the door assembly jig of the present invention.
Figure 3:
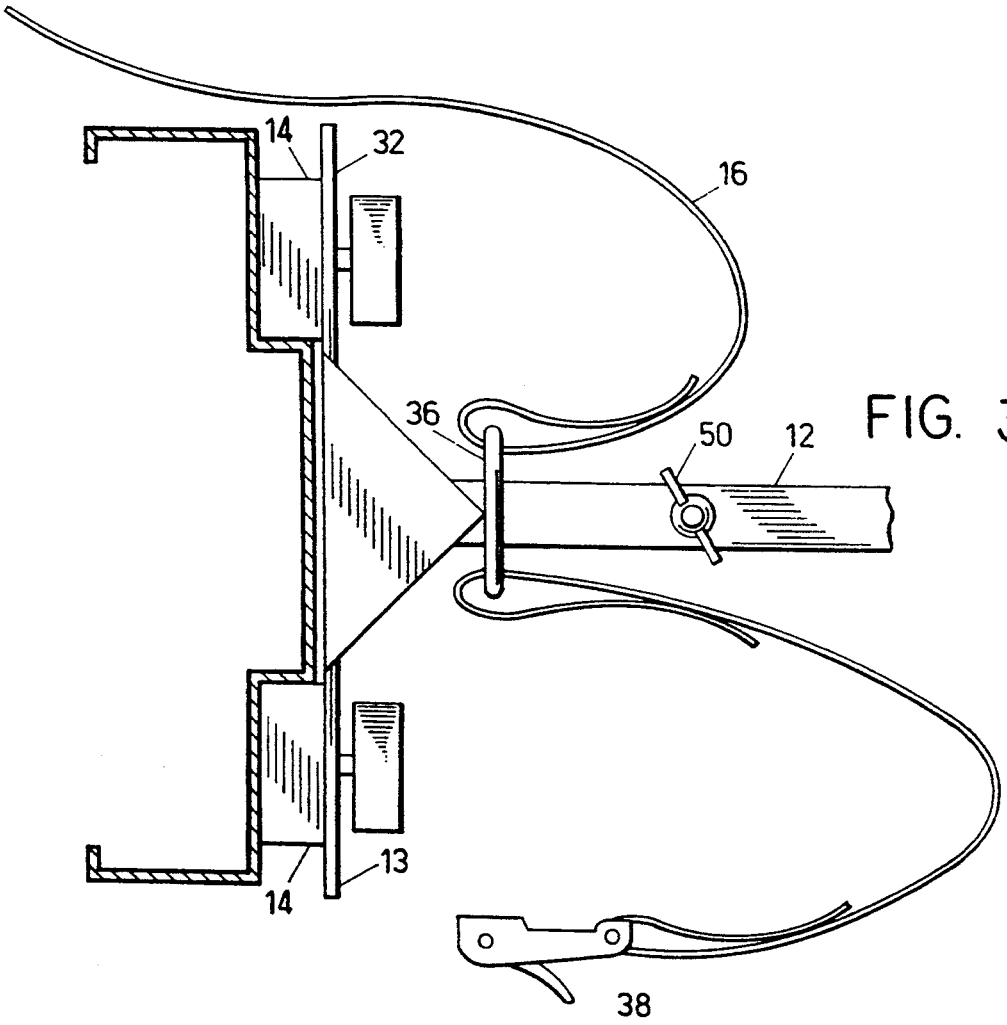
FIG. 3 is a detailed top view of the ends of the horizontal door spreading brace in the preferred embodiment.

FIG. 1 shows, at 10, the preferred embodiment of the door assembly jig of the present invention installed within a metal door frame. A horizontal door-spreading cross brace 12 spans the distance between side jambs. Preferably, each end of the door-spreading brace 12 includes means for securing the door-spreading brace 12 to the side jambs in the form of side jamb contacts 13. The side jamb contact 13, as best viewed in FIG. 3, includes an arm 32 perpendicular to the brace 12 on which are mounted a pair of contact blocks 14. The contact blocks 14 are attached to the arm 32 in a manner such that their position can be adjusted, to move them toward or away from the arm 32, to adjust for the depth of the jamb. A cinching strap 16 preferably further secures the door-spreading brace 12 to the side jambs and brings the side jambs of the door frame into correct alignment with each other. The cinching strap 16 includes two straps, each attached at one end by a fastener 36 to the brace 12, and one strap having at its other end a fastener 38 to secure to the other strap. The length of the brace 12 adjusts in length to adjust for use with a variety of width of door frames. In the preferred embodiment, the desired length adjustability is achieved by forming the brace 12 from a pair of interlocking tubes one of which slides inside the other. The two tubes may be secured at the desired length by means of a thumb screw and wing nut.

Figure 2:
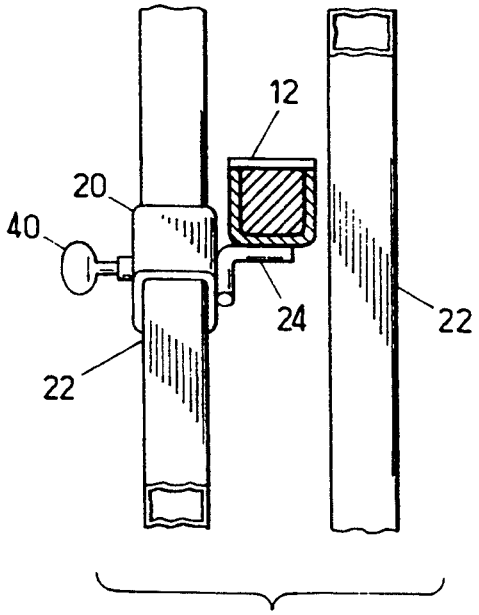
FIG. 2 is a detailed view showing a preferred connection at the area of overlap between the horizontal door spreader and the squaring braces.

The horizontal center of the door-spreading cross brace 12 is supported by a spreader support tab 20. Tab 20 anchors the door-spreading brace 12 by means of a finger 24 that extends from the body of the tab 20 to the underside of the door-spreading brace 12, as shown in FIG. 2. In the preferred embodiment the support tab 20 is slidably mounted around one of the squaring braces 22 and secured in any given position along the squaring brace 22 by means of a thumbscrew 40. The form of connection used to support the horizontal door-spreading brace 12 on the support tab 20 shown here is preferred, but other forms of mechanical connection which permits the pivoting of the squaring braces 22 relative to the door-spreading brace 12 is acceptable.

The diagonal squaring braces 22 determine the corner-to-corner diagonal distance within a door frame and are preferably telescoping to adjust to various door frame sizes. Clearly, if the length of the two squaring braces 22 is equal, the door will be squared if the braces fit into the door frame. In the preferred embodiment, the length adjustment of the squaring braces is accomplished by forming each squaring brace 22 of two threadedly interconnected pieces 42 and 44 held at the desired length by a nut keeper assembly 46, as shown in FIG. 1. At each end of each squaring brace 22, a terminal portion 26 is attached, which guides the squaring braces to the door frame corners. The terminal portions 26 are preferably formed of the same rigid material as the diagonal and horizontal braces, and may be welded or otherwise affixed perpendicular to the squaring brace ends. However, the squaring braces 22 may terminate in any form that ensures corner-to-corner placement. The spreader support tab 20 may be slid along the squaring brace 22 to permit the door-spreading brace 12 to be adjusted to any desired vertical height from the floor.

Also provided in the preferred embodiment are a pair of plumbing braces 28 and an anchor plate 30, used together to plumb the squared metal door frame perpendicular to the floor of the structure under construction. The plumbing braces 28 include at each end a coupler 48. The plumbing braces 28 of the preferred embodiment employ the same telescoping design as the squaring braces 22, including the nut-keeper assembly 46, although other means for adjusting the length of the squaring braces 22 and the plumbing braces 28 are possible. The plumbing braces 28 are also adjustable in length and are adjusted to be the same length for a given installation. The coupler 48 at one end of each of the plumbing braces 28 is movably secured by a wingnut 50 to the spreading brace 12, while the other end of each of the plumbing braces 28 is secured by a wingnut 52 to a fastener 54 on the anchor plate in a manner which permits rotation of the plumbing braces 28 relative to the anchor plate 30. The anchor plate 30 itself has formed in it a series of holes so that it can be temporarily fixed to a floor or sub-floor to anchor the entire jig 10. Holes may be further provided in the anchor plate 30 for staking the plate 30 to the earth using, for example, steel or wood stakes. Staking to earth is often needed when setting frames in an exterior wall where only a footing is present with no adjacent floor or sub-floor.

In use, the interlocking portions of the door-spreading brace 12 are sized to fit and the brace 12 is tightly secured between the side jambs of the door frame. The door-spreading brace 12 is secured by abutting the adjustable blocks 14 against both sides of the door stop portion of each side jamb, and by securing the cinching straps 16 around the side jambs. Next, the diagonal squaring braces 22 are prepared for placement within the door frame. Each squaring brace 22 is roughly adjusted to fit between the opposite diagonal corners of the door frame. To ensure a perfectly square door frame, the squaring braces should be extended to identical lengths before installation. The squaring braces 22 are then positioned within the door frame as shown in FIG. 1, with one brace on either side of the door-spreading brace 12. After placing the squaring braces 22 into position, each brace may be extended or retracted to fit tightly in the four corners, thereby ensuring a rigid, square door frame. The spreader support tab 20 is moved along the squaring brace 22 until the finger 24 lies beneath the door-spreading squaring brace 12. While the two squaring braces hold the door frame square, the spreading brace 12 holds the sides of the door frame exactly the correct distance from each other. Having done so, all adjustments to the braces may be firmly secured.

Finally, to ensure that the door frame remains perpendicular to the plane of the ground or floor during wall construction, the plumbing braces 28 are adjusted to a desired length and attached to the horizontal door-spreading brace 12 and anchor plate 30. The anchor plate 30 is then temporarily fastened, by stakes, nails or screws, to the earth, floor, or sub-floor. The desired length of the plumbing braces 28 is that which holds the door frame perpendicular to the ground or floor after attachment to the door-spreading brace 12. As before, fine adjustment of the brace lengths is possible before the door assembly jig 10 is securely fastened. The fixed anchor plate 30 then supports the entire jig 10 as the jig 10 holds the door square, plumb, and in position. Then the construction of the wall surrounding the doorway, using bricks, concrete blocks, or the like may proceed. The door assembly jig 10 is left in place until the surrounding wall prevents movement of the metal door frame.

Between uses, the preferred embodiment may be easily transported by collapsing each adjustable brace to its smallest size and securing the braces together using the cinching straps 16 of the door-spreading brace 12. This portability is most readily achieved if the braces are formed of rectangular tubular material, as in the preferred embodiment. However, the present invention may also be practiced with an apparatus that is not collapsible.

In the apparatus of the present invention, metal door frames are less subject to misalignment during installation than they were with existing devices, since the frame and the assembly jig operate as a unit and all braces needed to square and plumb a metal door frame are physically interactive. Each brace restricts the movement of every other brace, thereby restricting movement of the attached door frame during construction.

It is to be understood that the present invention is not limited to the particular embodiment disclosed herein, nor to the particular uses outlined. The embodiment is intended to be exemplary, rather than limiting and shall embrace all such variations as come within the scope of the following claims.

We claim:

1. A door assembly jig for bracing a squared metal door frame for installation into a wall, the assembly jig comprising:

a pair of squaring braces, adjustable in length to match the diagonal length of the squared door frame;

a support tab having a finger extending therefrom, the tab being slidably mounted to one of the squaring braces;

an adjustable-length door spreading brace supported at its underside by the finger at a single support point, the support point being adjustable in position along the length of the squaring braces;

securing means located at each end of the door spreading brace for securing the side jambs of the door frame to the ends of the door spreading brace, so that the squaring braces, when installed diagonally between opposing corners of the door frame, will square the door frame at the same time that the door spreading brace fixes a constant distance between the side jambs of the door frame to prevent movement of the side jambs; and an anchor plate, the anchor plate adapted to connect to a floor; and a pair of plumbing braces being each connected at one end to the door-spreading brace and each connected at the opposite end to the anchor plate so as to plumb the door.

2. A door assembly jig as claimed in claim 1 wherein the lengths of the door-spreading brace and squaring braces are fixable at any desired length of adjustment.

3. A door assembly jig as claimed in claim 1 wherein a side jamb contact is mounted on each end of the spreading brace, each side jamb contact including a pair of adjustable depth contact blocks arranged to contact the sides of the door jamb.

4. A door assembly jig as claimed in claim 1 wherein at each end of the spreading brace a cinching strap is provided to secure to the side jamb of the door frame.

5. A method for squaring a metal door frame, comprising the steps of:

securing a door spreading brace to the side jambs of the door frame;

securing a pair of diagonal squaring braces between the diagonally opposite corners of the door frame;

supporting the door spreading brace at its underside at a single support point so that the squaring braces hold the door frame square while the spreading brace fixes a constant distance between the sides of the door frame and prevents outward spreading of the base of the side jambs;

securing an anchor plate to the ground or floor;

ensuring that the door frame is perpendicular to the ground or floor; and securing a pair of plumbing braces to the door-spreading brace and to the anchor plate.

* * * * *